US008995881B2

(12) United States Patent
Kawai

(10) Patent No.: US 8,995,881 B2
(45) Date of Patent: Mar. 31, 2015

(54) IMAGE FORMING APPARATUS AND IMAGE CARRIER INCLUDING A BACKWARD-ROTATION-SUPPRESSING MECHANISM

(71) Applicant: Fuji Xerox Co., Ltd., Tokyo (JP)

(72) Inventor: Jun Kawai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 30 days.

(21) Appl. No.: 13/961,062

(22) Filed: Aug. 7, 2013

(65) Prior Publication Data

US 2014/0294444 A1 Oct. 2, 2014

(30) Foreign Application Priority Data

Mar. 26, 2013 (JP) ..... 2013-065005

(51) Int. Cl.
*G03G 15/00* (2006.01)

(52) U.S. Cl.
CPC ..... *G03G 15/757* (2013.01)
USPC ..... 399/167

(58) Field of Classification Search
CPC ..... G03G 15/757
USPC ..... 399/167; 74/DIG. 4; 464/29
See application file for complete search history.

(56) References Cited

U.S. PATENT DOCUMENTS

| | | | | |
|---|---|---|---|---|
| 4,967,239 | A * | 10/1990 | Sakakura | |
| 7,577,382 | B2 * | 8/2009 | Sato et al. | 399/167 |
| 7,824,162 | B2 * | 11/2010 | Wilder | 464/29 |
| 8,346,131 | B2 * | 1/2013 | Kim | 399/167 |
| 8,485,334 | B2 * | 7/2013 | Chiang et al. | 464/29 |
| 2008/0207336 | A1 | 8/2008 | Yokoyama | |
| 2013/0302066 | A1 * | 11/2013 | Kawai | 399/167 |

FOREIGN PATENT DOCUMENTS

JP 2008-202757 A 9/2008

* cited by examiner

*Primary Examiner* — Susan Lee
(74) *Attorney, Agent, or Firm* — Sughrue Mion, PLLC

(57) ABSTRACT

An image forming apparatus includes a driving portion configured to generate a driving force, a first magnet configured to rotate when receiving the driving force from the driving portion, a second magnet that faces the first magnet with a gap interposed therebetween and is configured to rotate together with the first magnet while attracting and being attracted by the first magnet with magnetism, a rotating member configured to rotate in a predetermined direction when receiving the driving force from the second magnet, and a backward-rotation-suppressing mechanism configured to suppress rotation of the rotating member in a direction opposite to the predetermined direction.

6 Claims, 9 Drawing Sheets

IMAGE FORMING APPARATUS AND IMAGE CARRIER INCLUDING A BACKWARD-ROTATION-SUPPRESSING MECHANISM

CROSS-REFERENCE TO RELATED APPLICATIONS

This application is based on and claims priority under 35 USC 119 from Japanese Patent Application No. 2013-065005 filed Mar. 26, 2013.

BACKGROUND

The present invention relates to an image forming apparatus and an image carrier.

SUMMARY

According to an aspect of the invention, an image forming apparatus includes a driving portion configured to generate a driving force, a first magnet configured to rotate when receiving the driving force from the driving portion, a second magnet that faces the first magnet with a gap interposed therebetween and is configured to rotate together with the first magnet while attracting and being attracted by the first magnet with magnetism, a rotating member configured to rotate in a predetermined direction when receiving the driving force from the second magnet, and a backward-rotation-suppressing mechanism configured to suppress rotation of the rotating member in a direction opposite to the predetermined direction.

BRIEF DESCRIPTION OF THE DRAWINGS

An exemplary embodiment of the present invention will be described in detail based on the following figures, wherein.

DETAILED DESCRIPTION

Configuration of Image Forming Apparatus 1

Figure 1:
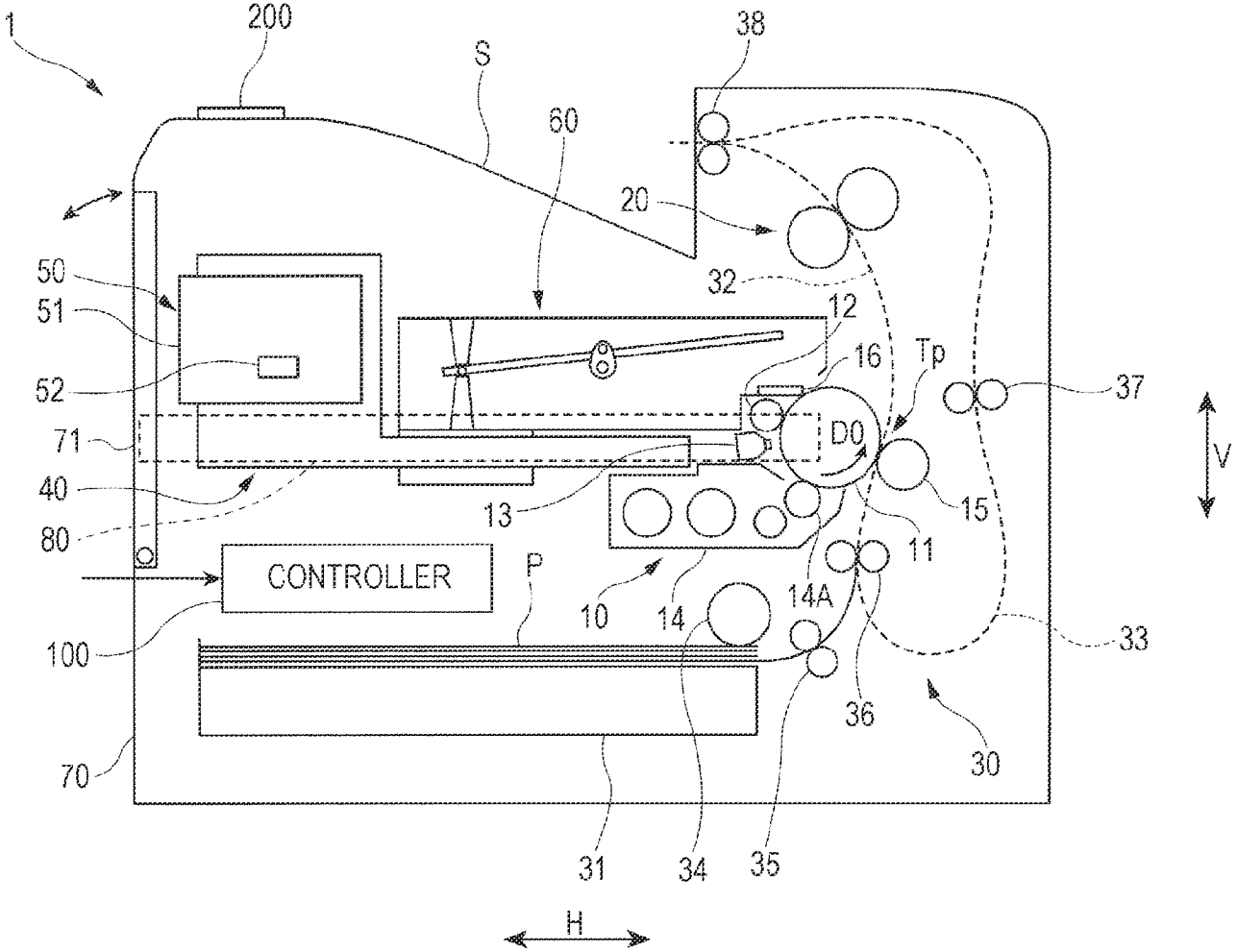
FIG. 1 illustrates an overall configuration of an image forming apparatus according to the exemplary embodiment.

Referring to FIG. 1, a configuration of an image forming apparatus 1 according to an exemplary embodiment of the present invention will first be described. FIG. 1 illustrates an overall configuration of the image forming apparatus 1 according to the exemplary embodiment.

The image forming apparatus 1 includes an image forming section 10 that forms a toner image on each piece of paper P, a fixing section 20 that fixes the toner image formed on the piece of paper P by the image forming section 10, and a paper transport system 30 that supplies each piece of paper P to the image forming section 10.

The image forming apparatus 1 further includes a toner transport section 40 that transports toner to the image forming section 10, a toner cartridge 50 that is provided in the toner transport section 40 and stores toner to be supplied to the image forming section 10, and a toner collecting device 60 that collects residual toner (to be described below) on a photoconductor drum 11 provided in the image forming section 10.

The image forming apparatus 1 further includes a controller 100 and a user interface (UI) 200. The controller 100 controls all operations performed by the image forming section 10, the fixing section 20, the paper transport system 30, the toner transport section 40, the toner cartridge 50, and the toner collecting device 60. The UI 200 includes a display panel, through which the UI 200 receives instructions from the user and displays messages and so forth to the user. The image forming apparatus 1 further includes a housing 70 that supports the above elements.

Hereinafter, the near side and the far side of the image forming apparatus 1 illustrated in FIG. 1 are also referred to as "front side" and "rear side", respectively. Furthermore, the horizontal direction and the vertical direction of the image forming apparatus 1 illustrated in FIG. 1 are also simply denoted as "horizontal direction H" and "vertical direction V", respectively. Furthermore, the direction of the rotational axis of the photoconductor drum 11 (to be described below) included in the image forming apparatus 1 is also simply referred to as "axial direction".

The image forming section 10 includes the photoconductor drum 11, a charging device 12 that charges the photoconductor drum 11, an exposure device 13 that performs exposure on the photoconductor drum 11, a developing device 14 that performs development on the photoconductor drum 11 that has been charged, a transfer device 15 that transfers a toner image formed on the photoconductor drum 11 to a piece of paper P, and a cleaning member 16 that cleans the photoconductor drum 11 after the transfer.

The photoconductor drum 11 includes a photosensitive layer (not illustrated) on the outer circumference thereof and rotates in a forward direction (see arrow D0 in FIG. 1). The photoconductor drum 11 is detachably attached to the housing 70. The attaching and detaching of the photoconductor drum 11 are performed through an open portion (not illustrated) that appears when a covering 71 included in the housing 70 is opened.

The housing 70 includes urging portions (not illustrated) such as springs that urge the photoconductor drum 11 in the horizontal direction H and the vertical direction V, and pressed portions (not illustrated) provided inside the housing 70 and against which the photoconductor drum 11 urged by the urging portions is pressed. The urging portions and the pressed portions in combination determine the position of the photoconductor drum 11 in the horizontal direction H and the vertical direction V. Hence, even if a gear-side magnet 125 or a drum-side magnet 117 (to be described below) is attached to a deflected position, vibrations that may occur in the photoconductor drum 11 because of the deflection are suppressed. The positioning of the photoconductor drum 11 in the axial direction will be described separately below.

The charging device 12 includes a charging roller provided in contact with the photoconductor drum 11 and charges the photoconductor drum 11 to a predetermined potential.

The exposure device 13 applies a laser beam to the photoconductor drum 11 so as to selectively perform exposure on the photoconductor drum 11 that has been charged by the charging device 12, whereby the exposure device 13 forms an electrostatic latent image on the photoconductor drum 11.

The developing device 14 stores two-component developer containing, for example, toner that is negatively charged and a carrier that is positively charged. The developing device 14 develops, with the toner, the electrostatic latent image formed on the photoconductor drum 11 with the aid of a developing roller 14A, thereby forming a toner image on the photoconductor drum 11.

The transfer device 15 includes a roller member and transfers the toner image on the photoconductor drum 11 to a piece of paper P by producing an electric field at a position (transfer part Tp) between the transfer device 15 and the photoconductor drum 11.

The cleaning member 16 is a plate-like member made of an elastic material such as thermosetting urethane rubber and having a predetermined thickness. The cleaning member 16 extends in the axial direction and is in contact with the surface of the photoconductor drum 11. The cleaning member 16 removes toner and so forth (hereinafter referred to as residual toner) remaining on the photoconductor drum 11 after the transfer of the toner image.

In the exemplary embodiment, the cleaning member 16 is provided on the downstream side with respect to the transfer device 15 in the direction of rotation of the photoconductor drum 11 and is in contact with the surface of the photoconductor drum 11 along the tangent line to the photoconductor drum 11.

The fixing section 20 includes a pressure roller and a heat roller (both not illustrated). The piece of paper P having the toner image transferred thereto is made to pass through the nip between the rollers, whereby the fixing section 20 fixes the toner image on the piece of paper P through a fixing process using heat and pressure.

The paper transport system 30 includes a paper storing portion 31 that stores plural pieces of paper P, a paper transport path 32 along which each piece of paper P is transported and that extends from the paper storing portion 31 through the transfer part Tp and the fixing section 20 to a paper stacking portion S on which the piece of paper P is to be stacked, and a reversal transport path 33 in which the piece of paper P having passed through the fixing section 20 is turned upside down and is supplied to the transfer part Tp again.

The paper transport system 30 includes a pickup roller 34 that picks up some pieces of paper P from the paper storing portion 31 storing plural pieces of paper P, and a pair of separating rollers 35 that separate one of the pieces of paper P picked up by the pickup roller 34 from the others and transport the piece of paper P toward the transfer part Tp.

The paper transport system 30 further includes a pair of registration rollers 36 that temporarily stop the transportation of the piece of paper P when not rotated, and supply the piece of paper P to the transfer part Tp by rotating at a predetermined timing while registering the piece of paper P.

The paper transport system 30 further includes a pair of transport rollers 37 that are provided on the reversal transport path 33 and transport the piece of paper P, and a pair of discharge rollers 38 that are provided on the downstream side in a paper transport direction with respect to a position where the paper transport path 32 and the reversal transport path 33 merge. The pair of discharge rollers 38 discharge the piece of paper P having undergone fixing toward the paper stacking portion S, or transport the piece of paper P toward the reversal transport path 33 when images are to be formed on both sides of the piece of paper P.

The toner transport section 40 holds the toner cartridge 50, which is interchangeable. The toner transport section 40 transports toner supplied thereto from the toner cartridge 50 toward the developing device 14 included in the image forming section 10.

The toner cartridge 50 includes a toner container 51 and a storage medium 52. The toner container 51 contains toner. The storage medium 52 is an electrically erasable and programmable read-only memory (EEPROM) or the like. The storage medium 52 stores information indicating the type of the toner cartridge 50, and information on the usage condition of the toner cartridge 50 such as the number of revolutions of a rotating member provided in the toner container 51 and that rotates and thus stirs the toner. If, for example, the toner in the toner container 51 runs out, the toner cartridge 50 is replaced with another toner cartridge 50.

The toner collecting device 60 collects and stores the residual toner removed from the photoconductor drum 11 by the cleaning member 16 after the transfer.

The controller 100 receives image data and printing instructions for image formation from a personal computer (PC) or the like that is connected to the image forming apparatus 1 over a network or the like. Furthermore, the controller 100 processes the image data thus received and sends the processed image data to the exposure device 13.

The controller 100 according to the exemplary embodiment includes a central processing unit (CPU), a read-only memory (ROM), a random access memory (RAM), and a hard disk drive (HDD) (all not illustrated). The CPU executes processing programs. The ROM stores programs, tables, parameters, and so forth. The RAM is used as a work area or the like when any of the programs is executed by the CPU.

Operation Performed by Image Forming Apparatus 1

An image forming operation performed by the image forming apparatus 1 according to the exemplary embodiment will now be described.

When image data generated by the PC or the like (not illustrated) is received by the controller 100, the controller 100 processes the image data. The image data thus processed is output to the exposure device 13. The exposure device 13 that have acquired the image data selectively performs exposure on the photoconductor drum 11 that has been charged by the charging device 12, thereby forming an electrostatic latent image on the photoconductor drum 11. The electrostatic latent image on the photoconductor drum 11 is developed into a toner image in, for example, black (K) by the developing device 14.

Meanwhile, in the paper transport system 30, the pickup roller 34 rotates in accordance with the timing of image formation, and some pieces of paper P are picked up from the paper storing portion 31. One of the pieces of paper P that has been separated from the others by the pair of separating rollers 35 is transported to the pair of registration rollers 36, where the piece of paper P is temporarily stopped. The pair of registration rollers 36 rotate in accordance with the timing of rotation of the photoconductor drum 11, whereby the piece of paper P is supplied to the transfer part Tp, where the toner image formed on the photoconductor drum 11 is transferred to the piece of paper P by the transfer device 15.

Subsequently, the piece of paper P having the toner image transferred thereto undergoes the fixing process in the fixing section 20, and is discharged to the paper stacking portion S by the pair of discharge rollers 38.

If another image is to be formed on a second side of the piece of paper P in addition to a first side of the piece of paper P (if images are to be formed on both sides of the piece of paper P), the piece of paper P that has passed through the fixing section 20 is transported into the reversal transport path 33 by the pair of discharge rollers 38 and is supplied to the transfer part Tp again by the pair of transport rollers 37. Then, another toner image formed on the photoconductor drum 11 is transferred to the second side of the piece of paper P at the transfer part Tp. The piece of paper P having the toner image transferred also to the second side thereof undergoes the fixing process in the fixing section 20 and is discharged onto the paper stacking portion S by the pair of discharge rollers 38.

After the above image formation is performed by the image forming section 10 and the toner image on the photoconductor drum 11 is transferred to the piece of paper P, the photoconductor drum 11 may have some residual toner. Such residual toner on the photoconductor drum 11 is removed by the cleaning member 16. The residual toner thus removed is collected by the toner collecting device 60.

Photoconductor Drum 11

Figure 2:
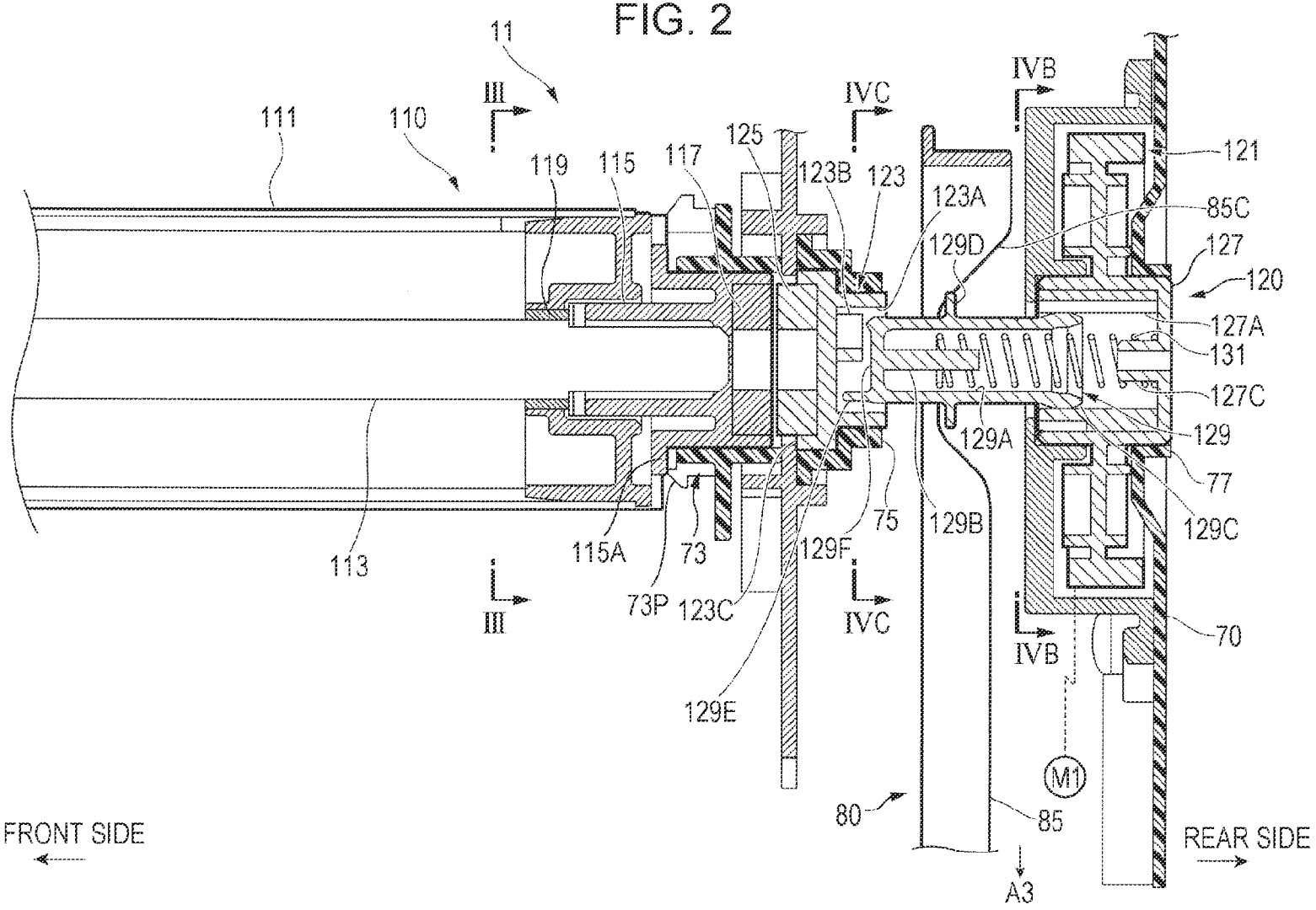
FIG. 2 is a schematic diagram illustrating a rear-side end of a photoconductor drum according to the exemplary embodiment.

Referring now to FIG. 2, a configuration including the photoconductor drum 11 and peripheral elements according to the exemplary embodiment will be described. FIG. 2 is a schematic diagram illustrating a rear-side end of the photoconductor drum 11 according to the exemplary embodiment.

As illustrated in FIG. 2, the photoconductor drum 11, which is an exemplary image carrier, includes a photoconductor drum unit 110 and a photoconductor-drum-driving mechanism 120 that transmits a driving force to the photoconductor drum unit 110. The photoconductor drum 11 includes a link mechanism 80 (to be described below) configured to cut the transmission of the driving force from the photoconductor-drum-driving mechanism 120.

Photoconductor Drum Unit 110

The photoconductor drum unit 110 includes a cylindrical photoconductor drum body (rotating member) 111 configured to carry a toner image on the outer circumferential surface thereof, a shaft 113 functioning as a rotating shaft of the photoconductor drum body 111, a drum-side-magnet-supporting member 115 provided at the rear-side end of the shaft 113 and rotating together with the shaft 113, and a drum-side magnet 117 (to be described below) supported by the drum-side-magnet-supporting member 115 coaxially with the shaft 113.

The photoconductor drum unit 110 includes a one-way clutch 119, which is a mechanism that transmits a rotational force only in one direction. The one-way clutch 119 is provided at the rear-side end of the photoconductor drum unit 110 and between the shaft 113 and the photoconductor drum body 111. The photoconductor drum unit 110 further includes a bearing (not illustrated) provided at the front-side end thereof and between the shaft 113 and the photoconductor drum body 111. At the front-side end of the photoconductor drum unit 110, the shaft 113 and the photoconductor drum body 111 are freely rotatable with respect to each other.

The above elements integrally form the photoconductor drum unit 110. The photoconductor drum unit 110 is detachably attached to the housing 70. More specifically, the photoconductor drum unit 110 illustrated in FIG. 2 is attached to the housing 70 in a direction intersecting the axial direction of the photoconductor drum unit 110 and from the near side toward the far side in FIG. 2. A driving force generated by the photoconductor-drum-driving mechanism 120 causes the photoconductor drum unit 110 as a whole to rotate about the shaft 113.

Figure 3:
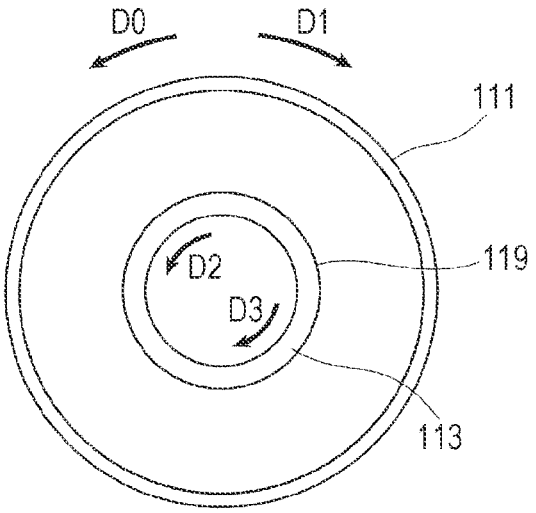
FIG. 3 is a sectional view taken along line III-III illustrated in FIG. 2.

Referring now to FIG. 3, the one-way clutch 119 will be described. FIG. 3 is a sectional view taken along line III-III illustrated in FIG. 2.

As illustrated in FIG. 3, the one-way clutch 119, which is an exemplary backward-rotation-suppressing mechanism, is an annular member and is provided between the shaft (rotating shaft) 113 and the photoconductor drum body (outer circumferential member) 111 in the diametrical direction of the shaft 113. That is, the shaft 113 is provided on the inner circumferential side of the one-way clutch 119, and the photoconductor drum body 111 is provided on the outer circumferential side of the one-way clutch 119.

The one-way clutch 119 transmits the driving force to the photoconductor drum body 111 when the shaft 113 rotates in the forward direction (see arrow D2 in FIG. 3), but does not transmit the driving force to the photoconductor drum body 111 when the shaft 113 rotates in the backward direction (see arrow D3 in FIG. 3). Furthermore, in the exemplary embodiment, since the one-way clutch 119 is provided, the shaft 113 is capable of causing the photoconductor drum body 111 to rotate in the forward direction (see arrow D0 in FIG. 3) but is not capable of causing the photoconductor drum body 111 to rotate in the backward direction (see arrow D1 in FIG. 3).

With the one-way clutch 119, the configuration of a driving path (the photoconductor-drum-driving mechanism 120, for example) for driving the photoconductor drum body 111 may be simplified. Furthermore, since the one-way clutch 119 is provided on the inner side of the photoconductor drum body 111, the configuration around the photoconductor drum unit 110 may be simplified.

Photoconductor-Drum-Driving Mechanism 120

Referring now to FIG. 2, the photoconductor-drum-driving mechanism 120 will be described.

The photoconductor-drum-driving mechanism 120 includes a motor (driving portion) M1 as a drive source, a train of gears (not illustrated) each rotating with the driving force transmitted thereto from the motor M1, a coupling gear 121 rotating with the driving force transmitted thereto from the train of gears, a gear-side-magnet-supporting member 123 rotating with the driving force transmitted thereto from the coupling gear 121, and a gear-side magnet 125 supported by the gear-side-magnet-supporting member 123. The coupling gear 121, the gear-side-magnet-supporting member 123, and the gear-side magnet 125 are coaxial with the shaft 113.

The coupling gear 121 includes a gear body 127, a coupling pin 129 coaxial with the gear body 127 and movable in the axial direction, and a spring 131 urging the coupling pin 129 in a direction of the rotational axis of the gear body 127 toward the photoconductor drum 11 (toward the front side).

The gear body 127 has a coupling-pin-receiving hole 127A that is open from the front-side face thereof and extending coaxially with the gear body 127. The coupling-pin-receiving hole 127A receives the coupling pin 129 and the spring 131 and has dimensions that allow the coupling pin 129 to move along the rotational axis of the gear body 127.

The gear body 127 has grooves 127B (see FIG. 4B to be referred to below) provided on the inner circumferential surface of the coupling-pin-receiving hole 127A and extending along the rotational axis of the gear body 127. In an exemplary configuration illustrated in FIG. 4B, two grooves 127B are provided across the rotational axis of the gear body 127 from each other.

The gear body 127 includes a holding member 127C that is a substantially columnar member extending in the coupling-pin-receiving hole 127A and coaxially with the coupling-pin-receiving hole 127A. A portion of the spring 131 is wound around and is thus held by the holding member 127C.

Figure 4A:
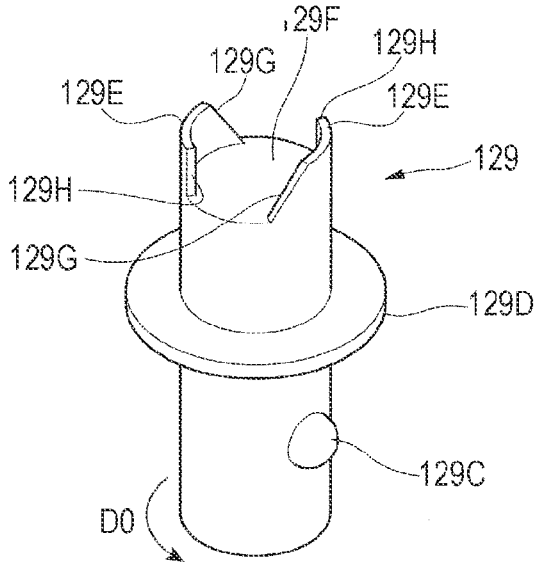
FIGS. 4A to 4C are schematic diagrams of a coupling pin.
Figure 4B:
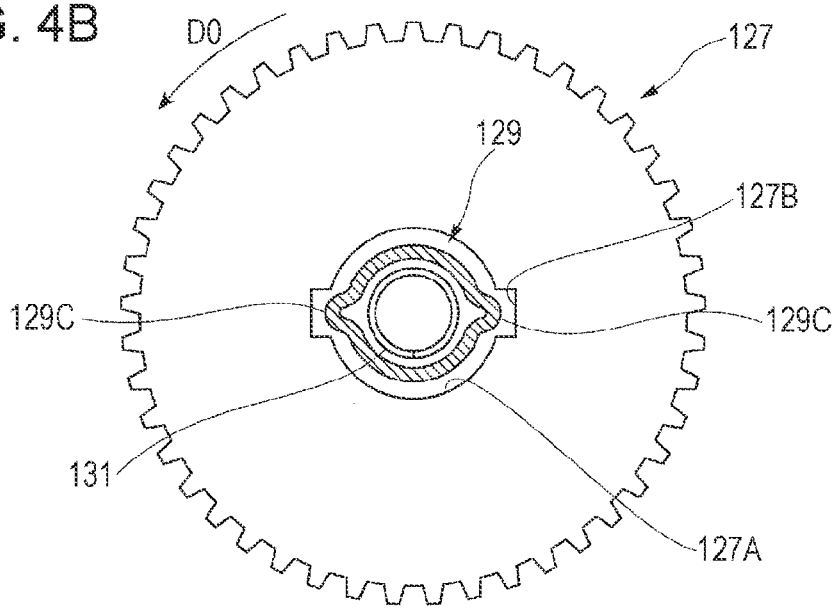
Figure 4C:
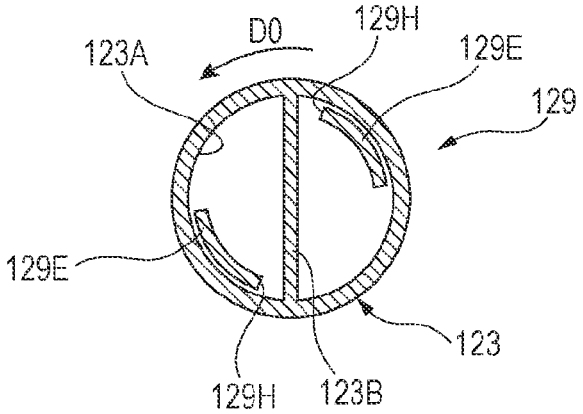

Referring now to FIGS. 2 and 4A to 4C, the coupling pin 129 will be described. FIGS. 4A to 4C are schematic diagrams of the coupling pin 129. More specifically, FIG. 4A is a perspective view of the coupling pin 129 seen from the front side. FIG. 4B is a sectional view taken along line IVB-IVB in FIG. 2 and illustrates the relationship between the coupling pin 129 and the gear body 127. FIG. 4C is a sectional view taken along line IVC-IVC in FIG. 2 and illustrates the relationship between the coupling pin 129 and the gear-side-magnet-supporting member 123.

As illustrated in FIGS. 2 and 4A, the coupling pin 129 is a substantially cylindrical member with one end (the rear-side end) thereof fitted in the coupling-pin-receiving hole 127A provided in the gear body 127. In the exemplary configuration illustrated in FIGS. 2 and 4A, the coupling pin 129 has a spring-receiving hole 129A extending in the axial direction thereof from a surface thereof facing the gear body 127 (facing toward the rear side). Furthermore, the coupling pin 129 includes a limiting portion 129B that is a substantially columnar member extending in the axial direction of the coupling pin 129 and provided at the bottom of the spring-receiving hole 129A. The limiting portion 129B limits the movement of the spring 131, provided in the spring-receiving hole 129A, in the radial direction.

The coupling pin 129 further includes projections 129C provided near the rear-side end on the outer circumferential surface thereof, a flange 129D (to be described in detail below) provided around the outer circumference thereof and at a position nearer to the front side than the projections 129C, and catches 129E projecting from a front-side end facet 129F thereof toward the rear side.

In the exemplary configuration illustrated in FIGS. 4A and 4B, two projections 129C are provided across the rotational axis of the coupling pin 129 from each other, and the projections 129C each have a substantially hemispherical shape on the outer circumferential surface of the coupling pin 129.

In the state where the coupling pin 129 is set in the coupling-pin-receiving hole 127A of the gear body 127 as illustrated in FIG. 4B, the projections 129C of the coupling pin 129 reside in the respective grooves 127B of the gear body 127. Hence, in the coupling-pin-receiving hole 127A of the gear body 127, the movement (relative movement) of the coupling pin 129 in the circumferential direction is limited while the movement (relative movement) of the coupling pin 129 in the axial direction is not limited.

Referring to FIG. 4A again, the catches 129E will be described. In the exemplary configuration illustrated in FIG. 4A, two catches 129E are provided across the rotational axis of the coupling pin 129 from each other. The catches 129E are each a plate-like member provided on the front-side end facet 129F of the coupling pin 129 and curving in the circumferential direction of the coupling pin 129. The catches 129E each have, at one end thereof in the circumferential direction, a sloping portion 129G sloping in a direction intersecting the front-side end facet 129F of the coupling pin 129.

Referring to FIG. 4C, the catches 129E of the coupling pin 129 are set in a recess 123A (to be described below) provided in the gear-side-magnet-supporting member 123. When the coupling pin 129 is driven to rotate about the rotational axis thereof, ends 129H of the respective catches 129E that are opposite the sloping portions 129G push a rib 123B (to be described below) provided in the recess 123A, thereby rotating the gear-side-magnet-supporting member 123 (see arrow D0 in FIG. 4C). In this manner, the driving force is transmitted from the coupling pin 129 to the gear-side-magnet-supporting member 123.

Referring now to FIG. 2, the gear-side-magnet-supporting member 123 and the gear-side magnet 125 will be described.

As illustrated in FIG. 2, the gear-side-magnet-supporting member 123 has, at the rear-side end thereof, the recess 123A in a region facing the coupling pin 129. Furthermore, the rib 123B is provided in the recess 123A. The rib 123B projects from the bottom of the recess 123A and extends in the diametrical direction. The rib 123B resides in a path along which the catches 129E move with the rotation of the coupling pin 129.

The gear-side-magnet-supporting member 123 includes a holding portion 123C provided at the front-side end thereof and that holds the gear-side magnet 125. In the exemplary configuration illustrated in FIG. 2, the holding portion 123C is an annular member that holds the gear-side magnet 125 at the inner circumference thereof.

The gear-side magnet 125 that is held by the gear-side-magnet-supporting member 123 is coaxial with the drum-side magnet 117 and faces the drum-side magnet 117.

Figure 5A:
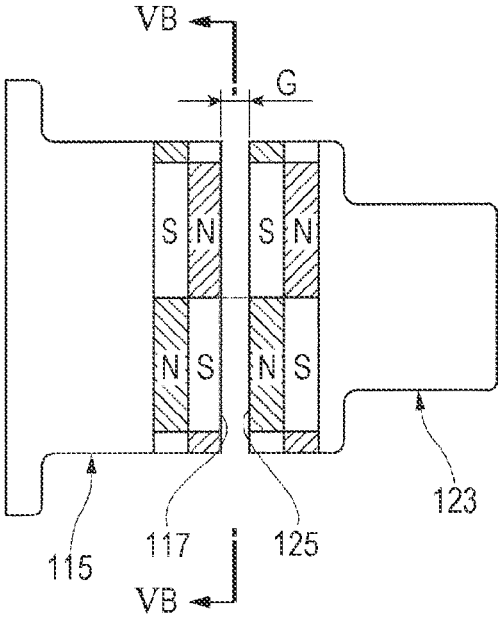
FIGS. 5A and 5B illustrate configurations of a drum-side magnet and a gear-side magnet.
Figure 5B:
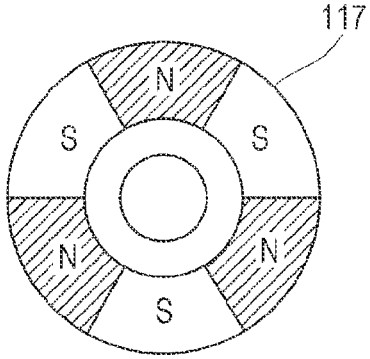

Referring now to FIGS. 5A and 5B, configurations of the drum-side magnet 117 and the gear-side magnet 125 will be described. FIGS. 5A and 5B illustrate the configurations of the drum-side magnet 117 and the gear-side magnet 125. More specifically, FIG. 5A illustrates the positional relationship between the drum-side magnet 117 and the gear-side magnet 125 that is realized when the two rotate together. FIG. 5B schematically illustrates the drum-side magnet 117 seen in a direction indicated by arrows VB in FIG. 5A.

The drum-side magnet (a second magnet, or a follower magnet) 117 and the gear-side magnet (a first magnet, or a driving magnet) 125 are each an annular plate-type magnet. As illustrated in FIG. 5B, the drum-side magnet 117 includes magnets arranged in the circumferential direction thereof such that the magnetic poles of adjacent magnets have opposite polarities. While three pairs of opposite magnetic polarities, the north pole and the south pole, are provided in the circumferential direction in the exemplary configuration illustrated in FIG. 5B, the number of pairs is not limited to three. The gear-side magnet 125 has the same configuration as the drum-side magnet 117, although not illustrated.

The gear-side magnet 125 and the drum-side magnet 117 in combination form a so-called magnet coupling. More specifically, each magnetic pole of each of the gear-side magnet 125 and the drum-side magnet 117 faces the opposite magnetic pole of the other with a gap (denoted by G in FIG. 5A) interposed therebetween. The gap G falls within a range in which the magnets 125 and 117 attract each other. When the gear-side magnet 125 is driven to rotate by the motor M1 of the photoconductor-drum-driving mechanism 120, the drum-side magnet 117 rotates. In this manner, the driving force from the motor M1 of the photoconductor-drum-driving mechanism 120 is transmitted to the photoconductor drum 11.

In the exemplary embodiment, the driving force is transmitted between the gear-side magnet 125 and the drum-side magnet 117 that are not in contact with each other. Therefore, noise is smaller and recycling is easier than in the case of a contact-type coupling. Furthermore, the deterioration of image quality, such as density nonuniformity (banding) caused by a resonance that may occur in the photoconductor drum 11 because of torsional rigidity, may be suppressed.

Since the gear-side magnet 125 and the drum-side magnet 117 attract each other with their magnetism, the position of the photoconductor drum unit 110 in the axial direction is determined. More specifically, since a flange 115A (see FIG. 2) included in the drum-side-magnet-supporting member 115 is pressed against a positioning portion 73P (see FIG. 2) included in the housing 70, the position of the photoconductor drum unit 110 in the axial direction is determined.

Housing 70

Referring now to FIG. 2, how the housing 70 according to the exemplary embodiment supports the photoconductor drum unit 110 and the photoconductor-drum-driving mechanism 120 will be described.

As illustrated in FIG. 2, the housing 70 includes a first bearing (not illustrated), a second bearing 73, a third bearing 75, and a fourth bearing 77 that support the photoconductor drum unit 110 and the photoconductor-drum-driving mechanism 120 while allowing the rotation of the two. The first bearing (not illustrated), the second bearing 73, the third bearing 75, and the fourth bearing 77 are provided in that order in the axial direction from the front side toward the rear side and are each a sliding bearing (oil-less bearing) made of resin or the like.

The first bearing (not illustrated) and the second bearing 73 support the front-side end and the rear-side end, respectively, of the shaft 113.

The second bearing 73 supports the drum-side-magnet-supporting member 115 while allowing the rotation of the drum-side-magnet-supporting member 115. The second bearing 73 includes the above-mentioned positioning portion 73P against which the flange 115A of the drum-side-magnet-supporting member 115 is pressed.

The third bearing 75 supports the gear-side-magnet-supporting member 123 while allowing the rotation of the gear-side-magnet-supporting member 123 and in such a manner as to hold both axial ends of the gear-side-magnet-supporting member 123. In this manner, the third bearing 75 suppresses the movement of the gear-side-magnet-supporting member 123 in the axial direction.

The fourth bearing 77 supports the coupling gear 121 while allowing the rotation of the coupling gear 121 and in such a manner as to hold both axial ends of the coupling gear 121. In this manner, the fourth bearing 77 suppresses the movement of the coupling gear 121 in the axial direction. The fourth bearing 77 also functions as a covering portion covering the coupling gear 121 and includes projecting portions 77A (see FIG. 6A to be referred to below) that guide the movement of a link 85 (to be described below).

Link Mechanism 80

Figure 6A:
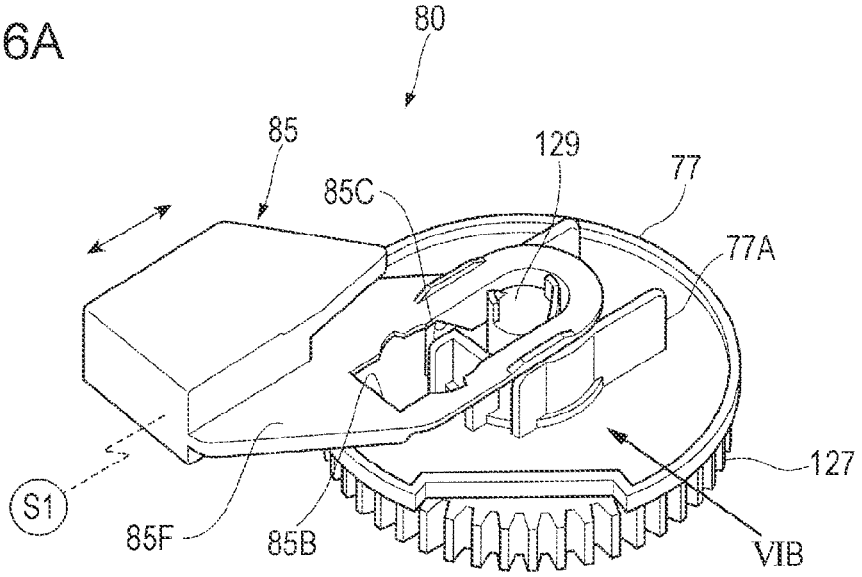
FIGS. 6A and 6B illustrate a configuration of a link mechanism.
Figure 6B:
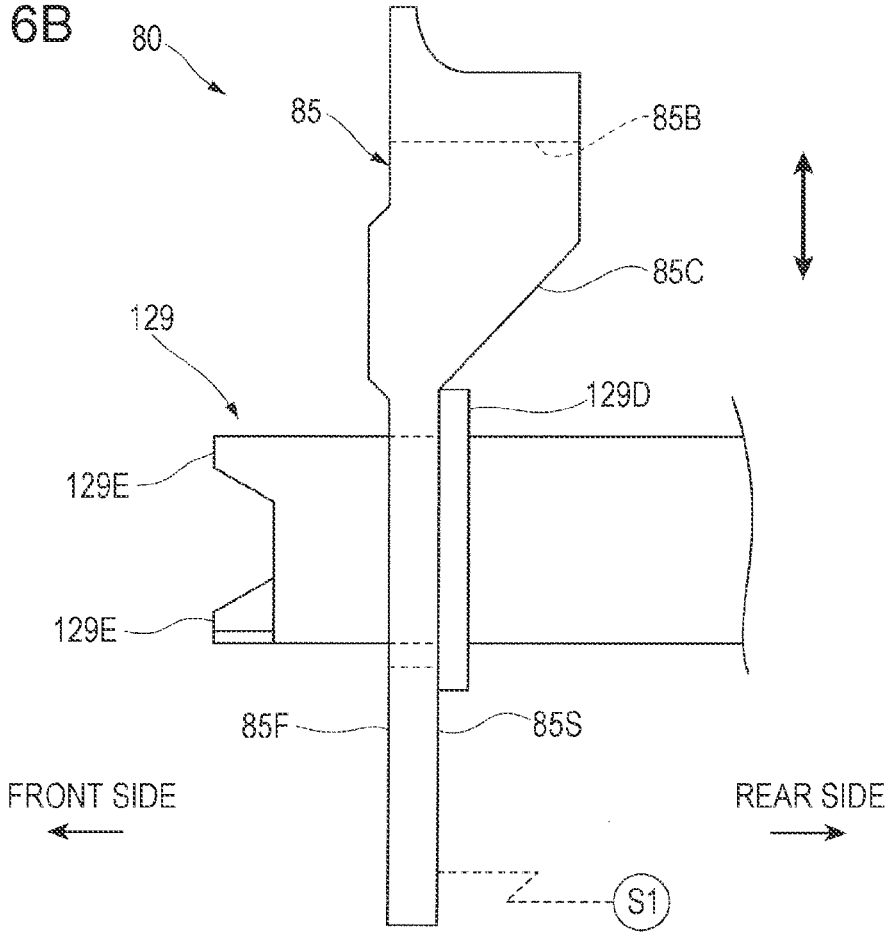

Referring now to FIGS. 6A and 6B, the link mechanism 80 according to the exemplary embodiment will be described. FIGS. 6A and 6B illustrate a configuration of the link mechanism 80. More specifically, FIG. 6A is a perspective view illustrating the link mechanism 80, the coupling pin 129, and peripheral elements. FIG. 6B illustrates the link mechanism 80 and the coupling pin 129 seen in a direction of arrow VIB in FIG. 6A.

As illustrated in FIG. 6A, the link mechanism 80 includes the link 85 connected to the coupling pin 129, a solenoid S1 functioning as a driving source that drives the link 85, and a sensor (not illustrated) provided at a position facing the covering 71 (see FIG. 1) and that is configured to detect the opening of the covering 71. The solenoid S1 is activated by, for example, receiving a control signal from the controller 100 that has received a detection signal from the sensor.

The link 85 is a substantially rectangular plate-like member and is connected to the solenoid S1 at one end thereof. Furthermore, the link 85 has a slit 85B at the other end thereof. The coupling pin 129 is held in the slit 85B. As illustrated in FIG. 6B, the link 85 has a sloping portion 85C on a rear-side face 85S thereof. The sloping portion 85C slopes toward the other end (the upper end in FIG. 6B) of the link 85 and in a direction away from a front-side face 85F of the link 85.

Since the coupling pin 129 is held in the slit 85B of the link 85, the rear-side face 85S of the link 85 is pressed against the flange 129D of the coupling pin 129. When the solenoid S1 is activated, the link 85 moves down or up in FIG. 6B (see the double-headed arrow in FIG. 6B). With the movement of the link 85, the flange 129D is pushed by the sloping portion 85C, whereby the coupling pin 129 moves in the axial direction (the lateral direction in FIG. 6B).

Movement of Photoconductor-Drum-Driving Mechanism 120

Figure 7:
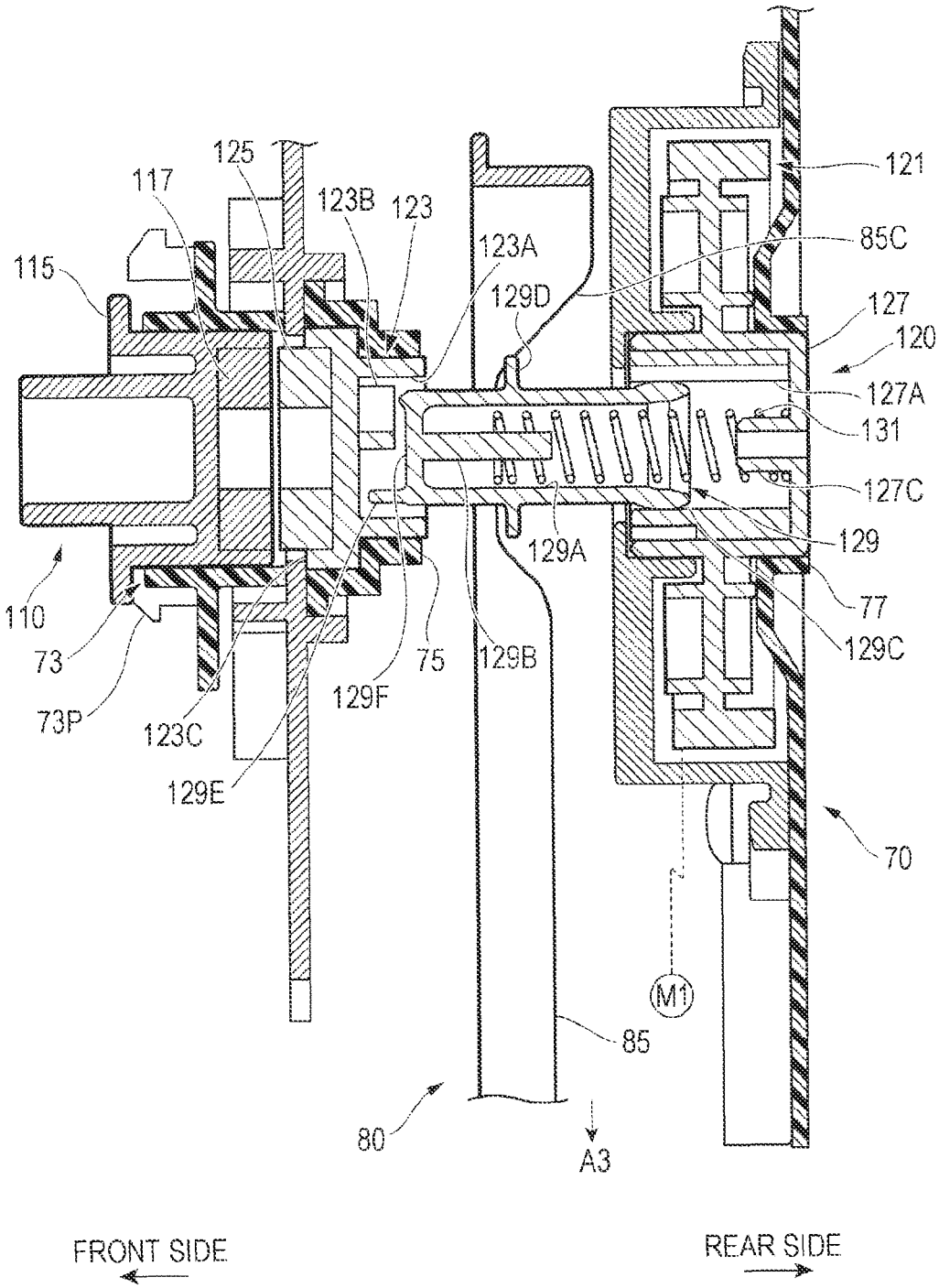
FIG. 7 illustrates a state of a photoconductor-drum-driving mechanism realized when a covering is closed.
Figure 8:
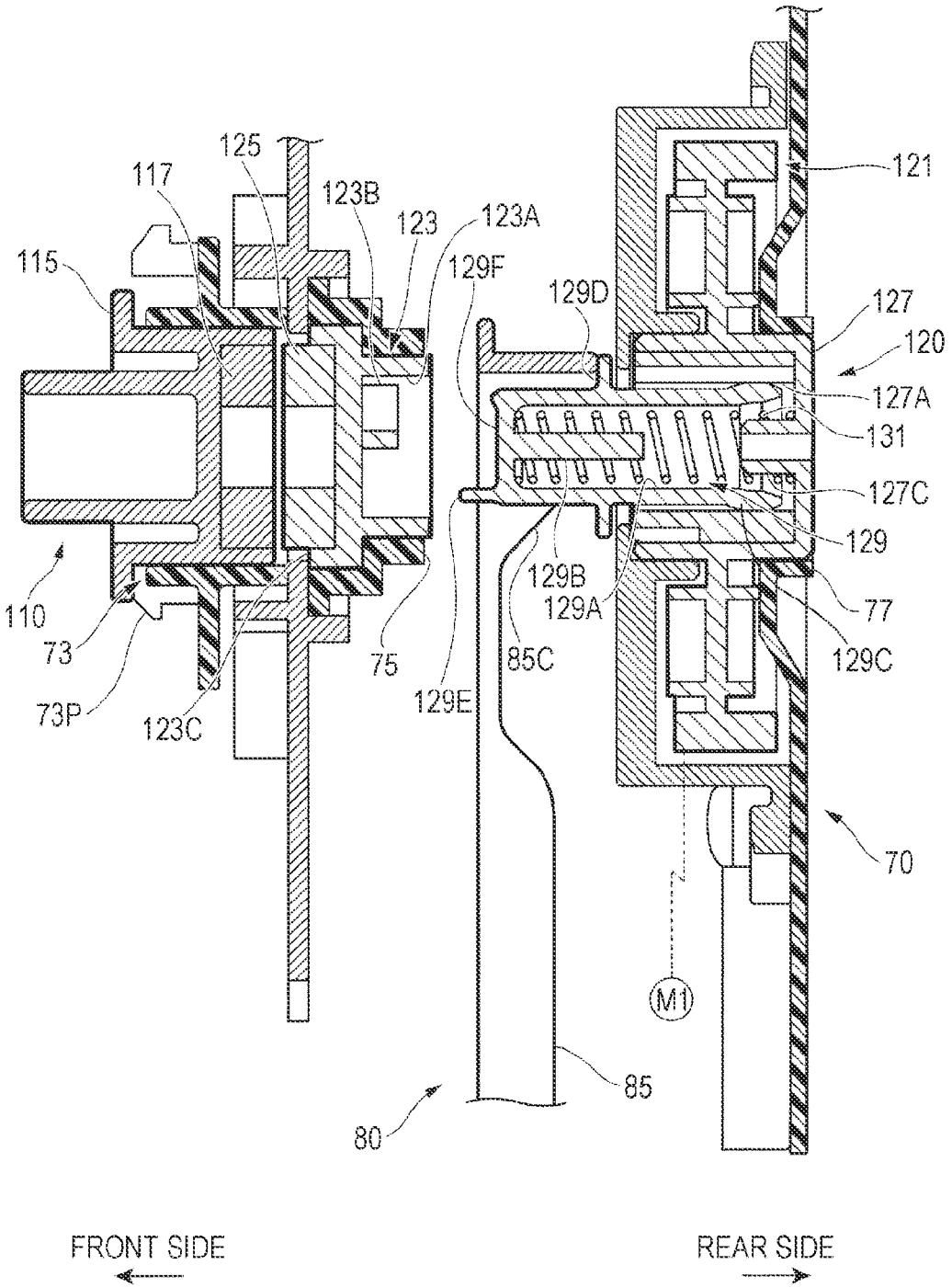
FIG. 8 illustrates a state of the photoconductor-drum-driving mechanism realized when the covering is open.

Referring now to FIGS. 7 and 8, how the photoconductor-drum-driving mechanism 120 moves with the above movement of the link mechanism 80 will be described. FIG. 7 illustrates a state of the photoconductor-drum-driving mechanism 120 realized when the covering 71 is closed. FIG. 8 illustrates a state of the photoconductor-drum-driving mechanism 120 realized when the covering 71 is open.

First, a movement of the coupling pin 129 that is made along with the movement of the link 85 of the link mechanism 80 will be described. As illustrated in FIG. 7, in the state where the covering 71 is closed, the solenoid S1 is not activated and the coupling pin 129 projects from the gear body 127. When the covering 71 is opened, the solenoid S1 is activated, whereby the sloping portion 85C of the link 85 pushes the flange 129D of the coupling pin 129 toward the rear side. Consequently, as illustrated in FIG. 8, the coupling pin 129 is embedded into the gear body 127.

Although detailed description is omitted, when the covering 71 that is in the open state is closed, the coupling pin 129 connected to the link 85 of the link mechanism 80 moves from the position of being embedded in the gear body 127 (see FIG. 8) to the position of projecting from the gear body 127 (see FIG. 7).

How the states of connections among the elements included in the photoconductor-drum-driving mechanism 120 change with the movement of the coupling pin 129 will now be described. As illustrated in FIG. 7, in the state where the covering 71 (see FIG. 1) is closed, the coupling pin 129 is at the position of projecting from the gear body 127. In this state, the rib 123B of the gear-side-magnet-supporting member 123 resides in the path along which the catches 129E move with the rotation of the coupling pin 129 about the rotational axis.

When the covering 71 is open as illustrated in FIG. 8, the coupling pin 129 is at the position of being embedded in the gear body 127. In this state, the coupling pin 129 is retracted from the gear-side-magnet-supporting member 123, and the rib 123B of the gear-side-magnet-supporting member 123 is retracted from the path along which the catches 129E moves with the rotation of the coupling pin 129. That is, the catches 129E are out of engagement with the rib 123B.

In such a state where the catches 129E and the rib 123B are not pressed against each other, the gear-side-magnet-supporting member 123 is rotatable independently of the coupling pin 129 or the coupling gear 121. More specifically, in the exemplary embodiment, in the state where the covering 71 is open, the gear-side-magnet-supporting member 123 and the gear-side magnet 125 are capable of rotating idly while being disconnected from the photoconductor-drum-driving mechanism 120 including the motor M1.

Hence, when, for example, the photoconductor drum unit 110 is exchanged with a new one, the gear-side-magnet-supporting member 123 and the gear-side magnet 125 are rotated idly, whereby the backward rotation of the photoconductor drum unit 110 may be suppressed.

In other words, the photoconductor-drum-driving mechanism 120 according to the exemplary embodiment may be regarded as a unit including an idling mechanism that allows only some members to rotate idly, or a unit including a connecting-and-disconnecting mechanism that switches between a connected state (a fixed state or a transmittable state) realized when the covering 71 is closed and a disconnected state (an idle state) realized when the covering 71 is open.

The above description concerns a configuration in which the link 85 is moved by using the solenoid S1. If the link 85 is connected to the covering 71 instead of being connected to the solenoid S1, the coupling pin 129 is movable by the link mechanism 80 with the opening of the covering 71.

Stopping Rotation of Photoconductor Drum Unit 110

Referring now to FIG. 2, how individual members move when the rotation of the photoconductor drum unit 110 is stopped will be described.

As described above, in the exemplary embodiment, the gear-side magnet 125 and the drum-side magnet 117 attract each other with their magnetism. Hence, when the gear-side magnet 125 rotates, the drum-side magnet 117 rotates. Thus, the driving force from the motor M1 included in the photoconductor-drum-driving mechanism 120 is transmitted to the photoconductor drum unit 110, and the photoconductor drum unit 110 rotates.

To stop the rotation of the photoconductor drum unit 110, the motor M1 is stopped. The gear-side magnet 125, which is mechanically connected to the motor M1, is also stopped together with the motor M1. Meanwhile, the drum-side magnet 117, which is spaced apart from the gear-side magnet 125 and is not mechanically connected to the motor M1, may continue to rotate with inertia even after the motor M1 is stopped. Furthermore, there may be a difference in the speed of rotation between the gear-side magnet 125 and the drum-side magnet 117.

When there is a difference in the speed of rotation between the gear-side magnet 125 and the drum-side magnet 117 because the speed of rotation of the gear-side magnet 125 is reduced (the gear-side magnet 125 stops rotating), the phase relationship between the gear-side magnet 125 and the drum-side magnet 117 may change from the predetermined phase relationship.

More specifically, the relationship between each of the magnetic poles of the gear-side magnet 125 and a corresponding one of the magnetic poles of the drum-side magnet 117 may change from the predetermined relationship (see FIG. 5A), that is, not a state where opposite magnetic poles face each other but a state where, for example, the same magnetic poles face each other. In such a case, a force acting to change the relative positions of the gear-side magnet 125 and the drum-side magnet 117 (a force that tends to restore the predetermined phase relationship) occurs with the magnetism.

The force acting to change the relative positions of the gear-side magnet 125 and the drum-side magnet 117 acts as a force causing the gear-side magnet 125 and the drum-side magnet 117 to rotate. Depending on the positional relationship between the gear-side magnet 125 and the drum-side magnet 117, the force may cause the photoconductor drum body 111 to rotate in the backward direction (see arrow D1 in FIG. 3).

If the photoconductor drum body 111 rotates in the backward direction (see arrow D1 in FIG. 3), the cleaning member 16 provided in contact with the surface of the photoconductor drum 11 so as to clean the photoconductor drum body 111 after the transfer may be rolled up. Furthermore, in an area where the photoconductor drum body 111 and the developing roller 14A of the developing device 14 face each other, the developer carried by the developing roller 14A may be removed from the developing roller 14A. Consequently, the transferability may be deteriorated at the start of rotation of the photoconductor drum body 111. Such phenomena lead to some deterioration in the quality of an image to be formed on the piece of paper P.

In the exemplary embodiment, however, the one-way clutch 119 is provided between the shaft 113 and the photoconductor drum body 111 as described above, and the one-way clutch 119 does not transmit the driving force acting in such a direction that the shaft 113 tends to cause the photoconductor drum body 111 to rotate in the backward direction.

Hence, even if the drum-side magnet 117 that has received a magnetic force from the gear-side magnet 125 acts to rotate the photoconductor drum body 111 in the backward direction, the driving force is not transmitted to the photoconductor drum body 111. Therefore, the photoconductor drum body 111 does not rotate in the backward direction. In this state, the magnetic force generated between the gear-side magnet 125 and the drum-side magnet 117 causes the drum-side magnet 117, the drum-side-magnet-supporting member 115, and the shaft 113 to rotate idly without causing the photoconductor drum body 111 to rotate.

Results of Measurement

Figure 9A:
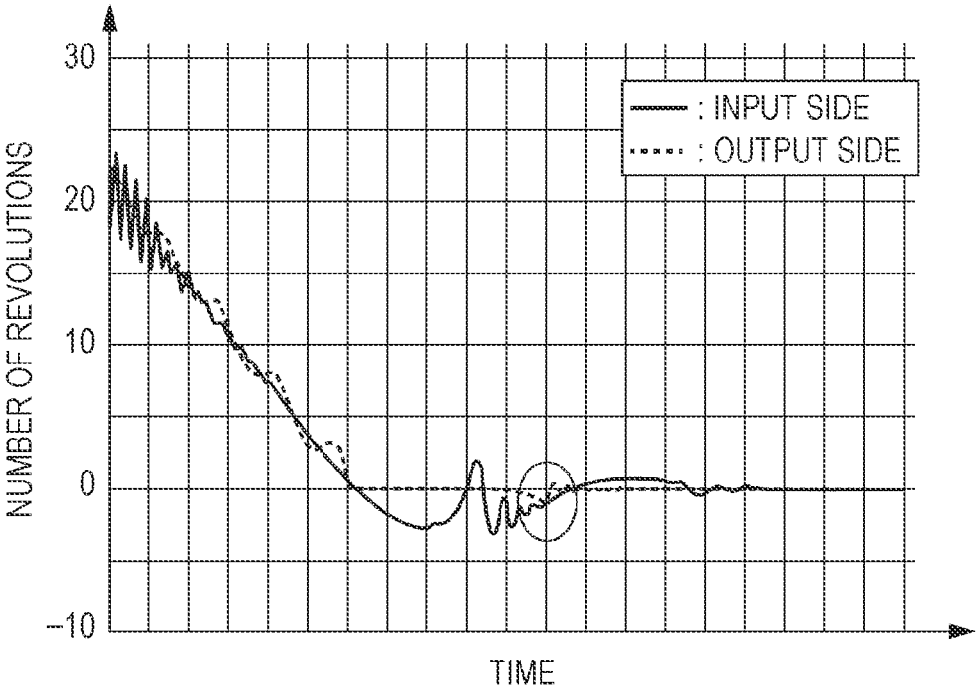
FIGS. 9A and 9B are graphs illustrating changes in the movement of a photoconductor drum body that are observed without and with a one-way clutch, respectively.
Figure 9B:
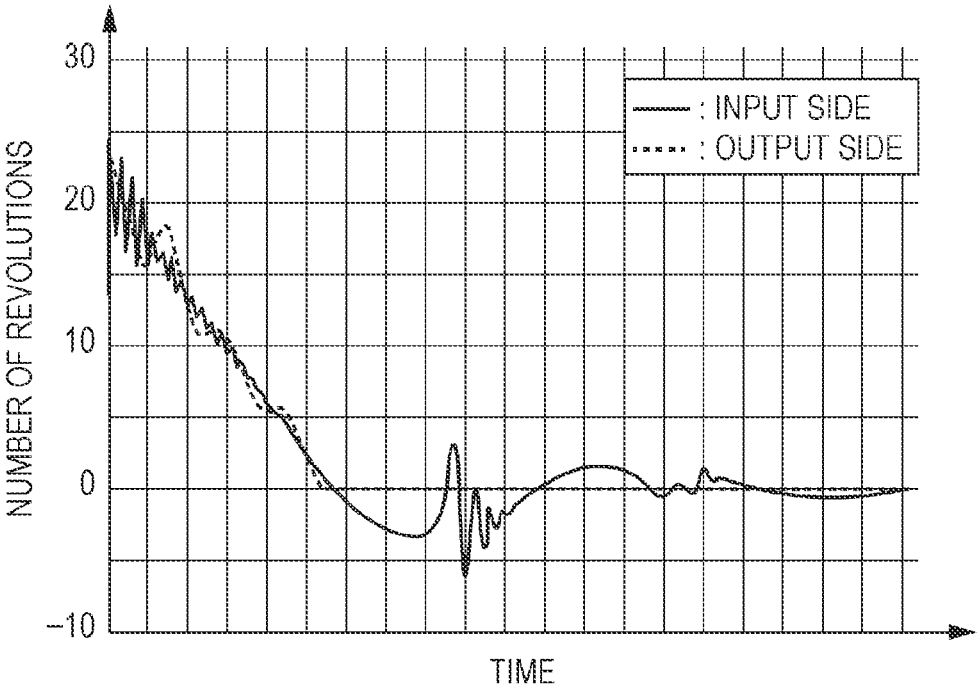

Referring now to FIGS. 9A and 9B, changes in the movement of the photoconductor drum body 111 that are observed in a case where the one-way clutch 119 is not provided and in a case where the one-way clutch 119 is provided will be described.

FIGS. 9A and 9B are graphs illustrating changes in the movement of the photoconductor drum body 111 that are observed without and with the one-way clutch 119, respectively. In the each of the graphs, the horizontal axis represents time, and the vertical axis represents the number of revolutions. Furthermore, the solid-line curve for the input side represents the rotation of the gear-side magnet 125, and the broken-line curve for the output side represents the rotation of the photoconductor drum body 111. Furthermore, in each of the graphs, the number of revolutions of the photoconductor drum body 111 in the forward direction (see arrow D0 in FIG. 3) is positive, and the number of revolutions of the photoconductor drum body 111 in the backward direction (see arrow D1 in FIG. 3) is negative.

Referring to FIG. 9A, the case where the one-way clutch 119 is not provided, unlike the exemplary embodiment, will be described. As is seen from the graph in FIG. 9A, stopping the rotation of the gear-side magnet 125 on the input side is accompanied by a period in which the number of revolutions of the photoconductor drum body 111 (represented by the broken-line curve in the graph) is negative (see the ovally enclosed area in the graph). That is, in the graph in FIG. 9A, the photoconductor drum body 111 rotates in the backward direction (see arrow D1 in FIG. 3).

In contrast, in the case of the graph illustrated in FIG. 9B where the one-way clutch 119 is provided, there is no period in which the number of revolutions of the photoconductor drum body 111 is negative. That is, providing the one-way clutch 119 suppresses the rotation of the photoconductor drum body 111 in the backward direction (see arrow D1 in FIG. 3).

Modifications

The exemplary configuration illustrated in the drawings concerns a case where the one-way clutch 119 is provided between the shaft 113 and the photoconductor drum body 111. The one-way clutch 119 only needs to suppress the transmission of the driving force to the photoconductor drum body 111 when the one-way clutch 119 has received the driving force acting in such a direction that the drum-side magnet 117 tends to cause the photoconductor drum body 111 to rotate in the backward direction (see arrow D1 in FIG. 3).

Hence, the one-way clutch 119 only needs to be provided in a path along which the driving force is transmitted from the drum-side magnet 117 to the photoconductor drum body 111. For example, the one-way clutch 119 may be provided between the drum-side magnet 117 and the drum-side-magnet-supporting member 115 or between the drum-side-magnet-supporting member 115 and the shaft 113. Alternatively, the one-way clutch 119 may be provided as a substituted for the second bearing 73, with the drum-side-magnet-supporting member 115 being provided on the inner circumferential side of the one-way clutch 119 such that the drum-side-magnet-supporting member 115 is allowed to rotate in the forward direction but is not allowed to rotate in the backward direction.

The exemplary configuration illustrated in the drawings concerns a case where the photoconductor drum unit 110 includes the one-way clutch 119 at the rear-side end thereof and the bearing (not illustrated) at the front-side end thereof. The present invention is not limited to such a case. For example, the photoconductor drum unit 110 may include the one-way clutch 119 at the front-side end thereof and the bearing at the rear-side end thereof. For another example, the one-way clutch 119 may be provided at each of the rear-side end and the front-side end of the photoconductor drum unit 110. If the one-way clutch 119 is provided at the end of the photoconductor drum unit 110 having the drum-side magnet 117 (the rear-side end in the exemplary configuration illustrated in the drawings), the backward rotation of the photoconductor drum unit 110 due to torsion may be suppressed more than in the case where the one-way clutch 119 is provided at the front-side end of the photoconductor drum unit 110.

While the above exemplary embodiment employs the one-way clutch 119, any other mechanism may alternatively be employed as long as the mechanism suppresses the rotation of the photoconductor drum unit 110 in the backward rotation (see arrow D1 in the drawings) that may occur when the rotation of the photoconductor drum unit 110 is stopped.

Specifically, the one-way clutch 119 may be substituted by a mechanism in which the link 85 is moved by the solenoid S1. In such a mechanism, the controller 100 actuates the solenoid S1 before stopping the motor M1 so as to stop the rotation of the photoconductor drum unit 110. Subsequently, the link 85 driven by the solenoid S1 moves the coupling pin 129, whereby the coupling pin 129 moves to the position of being embedded in the gear body 127 as illustrated in FIG. 8. This allows the gear-side-magnet-supporting member 123, the coupling pin 129, and the coupling gear 121 to rotate independently of one another.

Subsequently, the motor M1 is stopped, whereby the coupling pin 129 and the coupling gear 121 that are mechanically connected to the motor M1 are stopped. Meanwhile, the gear-side-magnet-supporting member 123 and the photoconductor drum unit 110 that have been disconnected from the coupling pin 129 and associated elements continue to rotate by inertia. In this state, the gear-side magnet 125 and the drum-side magnet 117 maintain to attract each other with their magnetism. Subsequently, because of the friction between the photoconductor drum unit 110 and the cleaning member 16 and so forth, the gear-side-magnet-supporting member 123 and the photoconductor drum unit 110 stop rotating.

Since the gear-side magnet 125 and the drum-side magnet 117 maintain to attract each other with their magnetism until the photoconductor drum unit 110 stops rotating, the gear-side magnet 125 and the drum-side magnet 117 tend to be prevented from becoming out of phase. In this manner, the rotation of the photoconductor drum unit 110 in the backward direction (see arrow D1 in the drawings) is suppressed. In this case, a group of the solenoid S1, the link 85, the coupling pin 129, and the gear-side-magnet-supporting member 123 is regarded as a backward-rotation-suppressing mechanism.

In the above case, the controller 100 actuates the solenoid S1 before stopping the motor M1. Alternatively, for example, the controller 100 may actuate the solenoid S1 after the motor M1 starts to decelerate so as to stop the photoconductor drum unit 110 and when the speed of the motor M1 has been reduced to or below a predetermined value.

The above description concerns a case where the rotation of the photoconductor drum body 111 in the backward direction (see arrow D1 in FIG. 3) is suppressed when the rotation of the photoconductor drum unit 110 is stopped. The exemplary embodiment is also applicable to a case where, for example, the photoconductor drum body 111 tends to rotate in the backward direction (see arrow D1 in FIG. 3) because the gear-side magnet 125 and the drum-side magnet 117 go out of phase when the rotation of the photoconductor drum unit 110 is accelerated or when the speed of rotation of the photoconductor drum unit 110 is changed by disturbance or the like.

While the exemplary configuration illustrated in the drawings concerns the photoconductor drum 11, the exemplary embodiment is also applicable to any other rotating member included in the image forming apparatus 1. For example, the exemplary embodiment is applicable to any of the developing device 14, the transfer device 15, the fixing section 20, the toner cartridge 50, and other rotating members.

In the exemplary configuration illustrated in the drawings, the drum-side magnet 117 and the gear-side magnet 125 are each an annular plate-type magnet. Alternatively, the magnet coupling may include, for example, an annular magnet and a cylindrical magnet that encloses the annular magnet.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a driving portion configured to generate a driving force;

a first magnet configured to rotate when receiving the driving force from the driving portion;

a second magnet that faces the first magnet with a gap interposed therebetween and is configured to rotate together with the first magnet while attracting and being attracted by the first magnet with magnetism;

a rotating member configured to rotate in a predetermined direction when receiving the driving force from the second magnet; and a backward-rotation-suppressing mechanism configured to suppress rotation of the rotating member in a direction opposite to the predetermined direction.

2. The image forming apparatus according to claim 1, wherein the backward-rotation-suppressing mechanism is provided in a path along which the driving force is transmitted from the second magnet to the rotating member, wherein the backward-rotation-suppressing mechanism transmits the driving force from the second magnet to the rotating member when the driving force acts in such a direction that the second magnet causes the rotating member to rotate in the predetermined direction, and wherein the backward-rotation-suppressing mechanism prevents the driving force from being transmitted from the second magnet to the rotating member when the driving force acts in such a direction that the second magnet causes the rotating member to rotate in the direction opposite to the predetermined direction.

3. The image forming apparatus according to claim 1, wherein the rotating member includes a rotating shaft that is configured to rotate and is provided with the second magnet at one axial end thereof; and an outer circumferential member that is provided around the rotating shaft and is configured to rotate together with the rotating shaft when an image is formed, and wherein the backward-rotation-suppressing mechanism is provided between the rotating shaft and the outer circumferential member in a diametrical direction of the rotating shaft.

4. The image forming apparatus according to claim 1, wherein the rotating member includes a rotating shaft that is configured to rotate and is provided with the second magnet at one axial end thereof; and an outer circumferential member that is provided around the rotating shaft and is configured to rotate together with the rotating shaft when an image is formed, and wherein the backward-rotation-suppressing mechanism is provided at the one axial end of the rotating shaft at which the second magnet is provided.

5. The image forming apparatus according to claim 1, wherein, in stopping rotation of the rotating member, the backward-rotation-suppressing mechanism cuts a path along which the driving force is transmitted from the driving portion to the first magnet.

6. An image carrier comprising:

a follower magnet that faces a driving magnet with a gap interposed therebetween, the driving magnet being configured to rotate when receiving a driving force, the follower magnet being configured to rotate together with the driving magnet while attracting and being attracted by the driving magnet with magnetism;

a rotating shaft that is configured to rotate and is provided with the follower magnet at one end thereof;

an outer circumferential member that is provided around the rotating shaft and is configured to rotate together with the rotating shaft and to carry an image on an outer circumferential surface thereof; and a transmission mechanism provided between the rotating shaft and the outer circumferential member in a diametrical direction of the rotating shaft, wherein the transmission mechanism transmits the driving force from the follower magnet to the outer circumferential member when the driving force acts in such a direction that the follower magnet causes the outer circumferential member to rotate in a predetermined direction, and wherein the transmission mechanism prevents the driving force from being transmitted from the follower magnet to the outer circumferential member when the driving force acts in such a direction that the follower magnet causes the outer circumferential member to rotate in a direction opposite to the predetermined direction.

* * * * *